US006068937A

United States Patent [19]

Nozawa et al.

[11] Patent Number: 6,068,937

[45] Date of Patent: May 30, 2000

[54] RECORDING SHEET AND METHOD OF RECORDING IMAGE USING SUCH RECORDING SHEET

[75] Inventors: Takashi Nozawa; Tetsuya Abe, both of Tochigi; Naoki Tanaka; Shuichi Yamaguchi, both of Nagano, all of Japan

[73] Assignees: Sony Chemicals Corporation, Tokyo; Seiko Epson Corporation, Nagano, both of Japan

[21] Appl. No.: 09/010,556

[22] Filed: Jan. 22, 1998

[30] Foreign Application Priority Data

Jan. 24, 1997 [JP] Japan ..... 9-025998

[51] Int. Cl.[7] ..... B41M 5/00

[52] U.S. Cl. ..... 428/522; 428/195; 428/474.4; 428/500; 347/105

[58] Field of Search ..... 428/195, 522, 428/500, 474.4; 347/105

[56] References Cited

U.S. PATENT DOCUMENTS

| | | | |
|---|---|---|---|
| 4,547,495 | 10/1985 | Bedell et al. | 428/500 |
| 4,887,097 | 12/1989 | Akiya et al. | 428/341 |

FOREIGN PATENT DOCUMENTS

| | | |
|---|---|---|
| 0 144 155 | 6/1985 | European Pat. Off. . |
| 38 43 681 A1 | 7/1989 | Germany . |
| 2 097 948 | 11/1982 | United Kingdom . |
| 2 213 078 | 8/1989 | United Kingdom . |
| WO 95/00340 | 1/1995 | WIPO . |

*Primary Examiner*—Pamela R. Schwartz
*Attorney, Agent, or Firm*—Hill & Simpson

[57] ABSTRACT

A recording sheet has a base and a receptive layer disposed on at least one surface of the base. The receptive layer contains at least a water-absorbent copolymer and said water-resistant graft copolymer whose main chain is polyvinyl alcohol. The water-absorbent copolymer absorbs inks, and the water-resistant graft copolymer makes the receptive layer resistant to discoloration, blurring, and gloss or luster irregularities. The water-absorbent graft copolymer comprises a graft copolymer produced by grafting a vinyl monomer having a carboxyl group and a monomer having a functional group reacting with the carboxyl group. The water-absorbent copolymer comprises a copolymer of acrylic acid and vinyl alcohol. The water-resistant graft copolymer and the water-absorbent copolymer are added at a ratio in parts by weight ranging from 20/80 to 80/20, preferably, from 30/70 to 70/30.

10 Claims, No Drawings

RECORDING SHEET AND METHOD OF RECORDING IMAGE USING SUCH RECORDING SHEET

BACKGROUND OF THE INVENTION

1. Field of the Invention

The present invention relates to a recording sheet and a method of recording an image using such a recording sheet, and more particularly to a recording sheet which is resistant to water and free of ink blurring, and a method of recording an image using such a recording sheet.

2. Description of the Prior Art

Ink-jet recording processes produce ink droplets based on various principles in ink-jet printers and apply the generated ink droplets to a receptive layer on a recording sheet for thereby forming a printed image thereon. Ink-jet printers are widely used in the art because they are capable of producing clear printed images and are relatively inexpensive to manufacture.

According to the ink-jet recording processes, water-base inks are generally used for protection against being dried in the ink-jet printers. The water-base inks that are used are so-called dye inks which comprise water-soluble dyes. Recording sheets for use with such dye inks generally have a receptive layer that is mainly made of a water-absorbent or water-soluble resin for receiving water-base inks.

One known recording sheet of the type described above is disclosed in Japanese patent publication No. 5-33150, for example.

The disclosed recording sheet has a receptive sheet which comprises a light-transmissive layer containing a copolymer of acrylic acid and vinyl alcohol or its salt. Since the copolymer of acrylic acid and vinyl alcohol or its salt is highly absorbent of water, can dry quickly, and is highly capable of transmitting light therethrough, the disclosed recording sheet can record images with high resolution and high color densities when used with water-base inks containing water-soluble dyes.

Recently, ink-jet printers have been attracting much attention for use in business applications. For example, ink-jet printers are used to print images on large recording sheets such as of A0, A1 or like sizes for thereby producing advertising sheets or posters. Such applications demand high-quality printed images because clearly printed images attract observer's attention easily.

One problem with recording sheets for use with ink-jet printers is that they are liable to absorb humidity in the ambient air as they are highly water-absorbent. Therefore, when images printed on such recording sheets are displayed indoors or outdoors over a long period of time, the images tend to be subject to blurring or characters included in the printed images are apt to decay easily.

It is known that the ability of recording sheets to resist water and discoloration can be improved by adding a hardener to their receptive layer. The above publication states that a hardener can be added to the receptive layer of the disclosed recording sheet. When a hardener was actually added to the receptive layer of the disclosed recording sheet, however, the ability of the receptive layer to absorb water was lowered, resulting in ink blurring and ink absorption irregularities though the ability of the receptive layer to resist water was somewhat increased. Therefore, the recording sheet disclosed in the above publication needs to be improved if it is to be used for printed materials that will be displayed indoors or outdoors over a long period of time.

If printed images are required to be resistant to discoloration and water, then pigment inks comprising pigments that can be dispersed well into water are used to print images. However, the pigment inks are disadvantageous in that they cannot easily permeate into a receptive layer, as the pigments are not water-soluble. Therefore, when a pigment ink is applied to the receptive layer of a recording sheet, the pigment which does not permeate into the receptive layer remains on the surface of the receptive layer and spreads around the printed region, resulting in blurring or gloss or luster irregularities on the printed image. If a linear image composed of a succession of dots is printed on the receptive layer of a recording sheet with a pigment ink, then the surface of the printed linear image tends to crack.

It has been desired in the art to improve recording sheets by solving the contradictory problems with respect to water absorption and water resistance.

SUMMARY OF THE INVENTION

It is an object of the present invention to provide a recording sheet which will produce a printed material that is highly resistant to water and can be displayed over a long period of time.

Another object of the present invention is to provide a recording sheet which allows images to be printed with a pigment ink without the problems of blurring and gloss or luster irregularities.

Still another object of the present invention is to provide a method of recording an image using such a recording sheet.

According to the present invention, there is provided a recording sheet comprising a base and a receptive layer disposed on at least one surface of the base, the receptive layer containing at least a water-absorbent copolymer and a water-resistant graft copolymer whose main chain is polyvinyl alcohol.

The water-resistant graft copolymer whose main chain is polyvinyl alcohol may comprise a graft copolymer produced by grafting a vinyl monomer having a carboxyl group and a monomer having a functional group reacting with the carboxyl group.

The water-absorbent copolymer may comprise a copolymer of acrylic acid and vinyl alcohol.

The water-resistant graft copolymer and the water-absorbent copolymer may be added at a ratio in parts by weight ranging from 20/80 to 80/20, preferably, from 30/70 to 70/30.

According to the present invention, there is also provided a method of recording an image on a recording sheet, comprising the steps of preparing a recording sheet comprising a base and a receptive layer disposed on at least one surface of the base, the receptive layer containing at least a water-absorbent copolymer and a water-resistant graft copolymer whose main chain is polyvinyl alcohol, and applying an ink mainly composed of a pigment to the receptive layer to form an image thereon.

The inventors have found out that the ability of the conventional recording sheet including a hardener to absorb inks is lowered because the receptive layer is hardened in its entirety. Based on this finding, the inventors have made a receptive layer of two resins, one being a water-absorbent copolymer for a high ink absorbing capability and the other being a water-resistant graft copolymer whose main chain is water-absorbent polyvinyl alcohol, and have discovered that the receptive layer thus formed can solve the contradictory problems with respect to water absorption and water resistance.

Specifically, the problems can be solved by containing, in the receptive layer, a highly ink-absorbent copolymer of acrylic acid and vinyl alcohol, and a self-crosslinking graft copolymer of polyvinyl alcohol. These copolymers are added at a predetermined ratio in parts by weight to make the receptive layer resistant to blurring and gloss or luster irregularities even when used with pigment inks.

DETAILED DESCRIPTION OF THE PREFERRED EMBODIMENTS

According to the present invention, a recording sheet has a base and a receptive layer disposed on at least one surface of the base.

The base is made of plastic film such as polyester film, polyimide film, polycarbonate film, polyethylene film, cellulose film, or the like, or paper.

If the recording sheet of the present invention is to be used as an advertising sheet or a poster, then the base may be made of white film which is the plastic film described above with a white pigment mixed therein.

The base may have a desired thickness which may be selected depending on the usage of the recording sheet, but generally have a thickness ranging from 5 m to 50 m.

The receptive layer of the recording sheet according to the present invention contains at least a copolymer of acrylic acid and vinyl alcohol and a graft copolymer of polyvinyl alcohol which is prepared by grafting a vinyl monomer having a carboxyl group and a monomer having a functional group reacting with the carboxyl group.

The copolymer of acrylic acid and vinyl alcohol is a water-absorbent copolymer (water-absorbing resin), and exhibits a high ink absorbing capability.

The copolymer of acrylic acid and vinyl alcohol can be prepared by copolymerizing a monomer of acrylic acid and a monomer of vinyl acetate and thereafter saponifying with a solution of methanol in the presence of an acid or an alkali. The produced copolymer may be used as a salt by being neutralized with caustic soda.

The copolymer of acrylic acid and vinyl alcohol is also commercially available. For example, Sumikagel L-5 or Sumikagel L-5H manufactured by Sumitomo Chemical Co. Ltd. may be used as the copolymer of acrylic acid and vinyl alcohol.

The water-absorbent graft copolymer whose main chain is polyvinyl alcohol is a water-absorbent resin, and may be a graft copolymer whose main chain is polyvinyl alcohol. In the graft copolymer, the vinyl monomer having a carboxyl group and the monomer having a functional group reacting with the carboxyl group are crosslinked with heat thereby to make the receptive layer highly resistant to water.

The vinyl monomer having a carboxyl group may be an (meth)acrylic acid, a maleic acid, an itaconic acid, or their esters.

The monomer having a functional group reacting with the carboxyl group may be an acrylamide such as N-methylol (meth)acrylamide, N-methoxymethyl(meth)acrylamide, or the like, or glycidyl(meth)acrylate, 2-hydroxyethyl(meth) acrylate, or the like.

The vinyl monomer having a carboxyl group and the monomer having a functional group reacting with the carboxyl group may be copolymerized at any of various ratios. Generally, 0.2~30 parts by weight of the vinyl monomer having a carboxyl group and 0.2~30 parts by weight of the monomer having a functional group reacting with the carboxyl group are used with respect to 100 parts by weight of polyvinyl alcohol.

The graft copolymer of polyvinyl alcohol is commercially available. For example, a graft copolymer of polyvinyl alcohol in MK series manufactured by Teikoku Kagaku Sangyo Co. Ltd. may be used as the graft copolymer of polyvinyl alcohol.

According to the present invention, a recording sheet which is highly resistant to water and free of blurring can be produced if the copolymer of acrylic acid and vinyl alcohol and the graft copolymer of polyvinyl alcohol are included at a ratio in parts by weight ranging from 20/80 to 80/20.

If pigment inks are to be used with a recording sheet according to the present invention, then a recording sheet which is free of gloss or luster irregularities and linear image cracking, as well as highly resistant to water and free of blurring, can be produced if the copolymer of acrylic acid and vinyl alcohol and the graft copolymer of polyvinyl alcohol are included at a ratio in parts by weight ranging from 30/70 to 70/30.

If the propotion of the copolymer of acrylic acid and vinyl alcohol were greater than the above ratio, then the resultant recording sheet would suffer linear image cracking. If the proportion of the graft copolymer of polyvinyl alcohol were greater than the above ratio, then the resultant recording sheet would suffer gloss or luster irregularities.

The receptive layer of the recording sheet according to the present invention generally, but not necessarily, have a thickness ranging from 5 $\mu$m to 50$\mu$m.

According to the present invention, another water-absorbent resin and another water-soluble resin maybe added. For example, polyvinyl alcohol, polyvinyl pyrrolidone, acrylic soda, gelatine, a cellulose such as hydroxyethyl cellulose or methyl cellulose, or its salt. Polyvinyl alcohol, in particular, is well compatible with each other, and hence can preferably be used for fine adjustments of printed images. Furthermore, it is possible to add a surface-active agent, a filler, and an ultraviolet light absorber.

A process of manufacturing a recording sheet according to the present invention will be described below.

First, the copolymers referred to above are dissolved and dispersed in a mixed solution of water and alcohol, producing a receptive layer solution.

Then, the receptive layer solution is coated on a base by a known coating device such as a bar coater, a knife coater, a comma coater, a gravure coater, or a fountain coater, and the solvent in the coated receptive layer solution is evaporated in a drying furnace associated with the coating device, thereby forming a receptive layer on the base.

The receptive layer is then heated at a temperature ranging from 100° C. to 150° C. The vinyl monomer having a carboxyl group which is contained in the copolymer of acrylic acid and vinyl alcohol and the monomer having a functional group reacting with the carboxyl group contained in the graft copolymer of polyvinyl alcohol react with each other, i.e., self-crosslinked, producing a desired recording sheet. If the drying furnace associated with the coating device is sufficiently long, it is possible to successively evaporate the solvent and heat the receptive layer in the drying furnace.

The recording sheet thus produced is then slitted to a desired size, such as A0 or A1 size, for use in business applications such as advertising sheets or posters. Alternatively, the recording sheet is slitted to another size, such as A4 or A5 size, for use in personal applications.

The recording sheet according to the present invention may be used on ink-jet printers or other recording devices which use inks, such as plotters. The recording sheet according to the present invention may be used with dye inks or pigment inks, the latter being more effective to confirm advantages that are offered by the recording sheet according to the present invention.

Inventive and comparative examples of the present invention will be described below.

INVENTIVE EXAMPLE 1

Preparation of a receptive layer solution:

50 parts by weight of a copolymer of acrylic acid and vinyl alcohol (L-5H manufactured by Sumitomo Chemical Co. Ltd.) and 50 parts by weight of a graft copolymer of polyvinyl alcohol (MK-2175 manufactured by Teikoku Kagaku Sangyo Co. Ltd.) were dissolved into water to produce a receptive layer solution containing 10% by weight of these copolymers.

Preparation of a recording sheet:

Then, the receptive layer solution was placed on one surface of a base of white polyester film having a thickness of 100 $\mu$m. Thereafter, an excessive receptive layer solution was scraped off the base by a bar coater, thereby coating a receptive layer in liquid form on the base.

Thereafter, the coated base was dried at 70° C. for 10 minutes, evaporating water, and then heated at 120° C. for 30 minutes, thus producing a desired recording sheet. The solid receptive layer on the base had a thickness of 15$\mu$m.

Evaluation:

Various images were printed on the produced recording sheet using pigment inks with an ink-jet plotter (JV-1300 manufactured by Mimaki Co. Ltd.), and evaluated as follows:

1. Water resistance of printed images:

After monochromatic character images were formed on the recording sheet in respective colors of Y (yellow), M (magenta), C (cyan), and black, water droplets were dropped onto the images with a pipette, and the images were left to stand at room temperature. After the water droplets were dried out, the printed character images were visually observed.

The observed results were evaluated using evaluation values "A", "B", "C", "A" for those character images which were free of blurring and decay and could be identified, "B" for whose character images which were subjected to blurring and decay and could be identified, and "C" for whose character images which could not be identified because of blurring and decay. The character images printed in Inventive example 1 were evaluated with "A" for water resistance.

2. Blurring of printed images:

Solid images were formed successively on the recording sheet in two different colors of magenta and yellow, with no gaps between the solid images, and were then visually observed for blurring in their boundaries.

Black character images were also printed on the recording sheet, and then visually observed for blurring.

The observed results were evaluated using evaluation values "A", "B", "C", "A" for those solid and character images which were free of blurring, "B" for those solid and character images which were practically acceptable though either the solid images or the character images were subjected to blurring, and "C" for those solid and character images which were both subjected to blurring and practically unacceptable. The solid and character images printed in Inventive example 1 were evaluated with "A" for blurring.

3. Gloss or luster irregularities:

A large solid image having a size of 2 cm×6 cm was printed on the recording sheet, and then visually observed for gloss or luster irregularities therein.

The observed results were evaluated using evaluation values "A", "B", "C", "A" for those solid images which had gloss or luster uniformity, "B" for those solid images which were practically acceptable though either the solid images were subjected to gloss or luster irregularities, "C" for those solid images which were subjected to gloss or luster irregularities in their entirety and practically unacceptable. The solid image printed in Inventive example 1 was evaluated with "A" for blurring gloss or luster irregularities.

4. Linear image cracking:

A linear image composed of a succession of dots was printed on the recording sheet, and the surface of the linear image was visually observed with a microscope for cracking.

The observed results were evaluated using evaluation values "A", "C", "A" for those linear images which were free of cracking in their entirety, "C" for those linear images which suffered cracking. The linear image in Inventive example 1 was evaluated with "A" for cracking.

Therefore, the recording sheet according to Inventive example 1 was evaluated with "A" for water resistance, blurring, gloss or luster irregularities, and cracking, and exhibited excellent printing capabilities.

INVENTIVE EXAMPLES 2~6 AND COMPARATIVE EXAMPLES 1~5

Recording sheets according to Inventive examples 2~6 and Comparative examples 1~5 were prepared in the same manner as the recording sheet according to Inventive example 1 except for different ratios in parts by weight of water-absorbent ratios of receptive layers. Then, the recording sheets according to Inventive examples 2~6 and Comparative examples 1~5 were evaluated using the same evaluation values as described above.

The ratios in parts by weight of the materials of the recording sheets according to Inventive examples 2~6 and Comparative examples 1~5 and their evaluations, in addition to the those of the recording sheet according to Inventive example 1, are given in Table below.

TABLE 1

| | *1 | *2 | *3 | *4 | *5 | *6 | *7 |
|---|---|---|---|---|---|---|---|
| In. Ex. 1 | 50 | 50 | — | A | A | A | A |
| In. Ex. 2 | 70 | 30 | — | A | A | B or A | A |
| In. Ex. 3 | 30 | 70 | — | A | A | B or A | A |
| In. Ex. 4 | 50 | 50 | 60 | A | A | A | A |
| In. Ex. 5 | 80 | 20 | — | B | A | B or A | C |
| In. Ex. 6 | 20 | 80 | — | A | B | C | A |
| Co. Ex. 1 | — | — | 100 | C | C | C | C |
| Co. Ex. 2 | 100 | — | — | C | A | C | C |
| Co. Ex. 3 | — | 100 | — | A | C | C | C |
| Co. Ex. 4 | 50 | — | 50 | C | A | C | C |
| Co. Ex. 5 | — | 50 | 50 | B | C | C | C |

*1: copolymer of acrylic acid and vinyl alcohol (parts by weight)
*2: graft copolymer of polyvinyl alcohol (parts by weight)
*3: polyvinyl alcohol (PVA235 manufactured by Kuraray Co. Ltd.) (parts by weight)
*4: water resistance
*5: blurring
*6: gloss or luster irregularities
*7: linear image cracking In Inventive examples 2, 3, 5, 6, the receptive layers were formed of a copolymer of acrylic acid and vinyl alcohol and a graft copolymer of polyvinyl alcohol at different ratios in parts by weight. In Inventive example 4, the receptive layer was formed of 50 parts by weight of a copolymer of acrylic acid and vinyl alcohol, 50 parts by weight of a graft copolymer of polyvinyl alcohol, and ordinary polyvinyl alcohol (PVA235 manufactured by Kuraray Co. Ltd.).

In Comparative example 1, the receptive layer was formed of only ordinary polyvinyl alcohol, described above, but not a copolymer of acrylic acid and vinyl alcohol and a graft copolymer of polyvinyl alcohol.

In Comparative example 2, the receptive layer was formed of only a copolymer of acrylic acid and vinyl alcohol.

In Comparative example 3, the receptive layer was formed of only a graft copolymer of polyvinyl alcohol.

In Comparative example 4, the receptive layer was formed of a copolymer of acrylic acid and vinyl alcohol and ordinary polyvinyl alcohol, described above.

In Comparative example 5, the receptive layer was formed of a graft copolymer of polyvinyl alcohol and ordinary polyvinyl alcohol, described above.

As can be seen from the evaluations given in above Table, the recording sheets according to Inventive examples 1~4 were excellent with respect to water resistance, freedom from gloss or luster irregularities, freedom from blurring, and freedom from linear image cracking. The recording sheets according to Inventive examples 5, 6 were practically usable though they suffer linear image cracking or gloss or luster irregularities.

It can be seen that an excellent recording sheet can be produced if the copolymer of acrylic acid and vinyl alcohol and the graft copolymer of polyvinyl alcohol are included at a ratio in parts by weight ranging from 30/70 to 70/30, and that a recording sheet which is practically acceptable can be produced if the copolymer of acrylic acid and vinyl alcohol and the graft copolymer of polyvinyl alcohol are included at a ratio in parts by weight ranging from 20/80 to 80/20.

The recording sheet produced by further adding ordinary polyvinyl alcohol to the copolymer of acrylic acid and vinyl alcohol and the graft copolymer of polyvinyl alcohol which are added at a ratio in parts by weight within the above range exhibited the most excellent recording capabilities, and constituted a best mode of the present invention.

In Comparative example 1, neither of the copolymers used in the receptive layer according to the present invention were added to the receptive layer. The recording sheet according to Comparative example 1 was practically unacceptable with respect to all the evaluation items.

In Comparative examples 2, 4, the copolymer of acrylic acid and vinyl alcohol was added to the receptive layer. Since, however, no graft copolymer of polyvinyl alcohol was added thereto, the recording sheets according to Comparative examples 2, 4 were not resistant to water and were practically unacceptable. The recording sheets according to Comparative examples 2, 4 were not better than the conventional recording sheets as to resistance to gloss or luster irregularities and linear image cracking.

In Comparative examples 3, 5, the graft copolymer of polyvinyl alcohol was added, but the copolymer of acrylic acid and vinyl alcohol was not added, to the receptive layer. Therefore, the recording sheets according to Comparative examples 3, 5 had a blurring problem, and were practically unacceptable. Furthermore, the recording sheets according to Comparative examples 3, 5 were not better than the conventional recording sheets as to resistance to gloss or luster irregularities and linear image cracking.

As can be understood from the evaluations of the recording sheets according to Inventive examples 1~6 and the recording sheets according to Comparative examples 2, 3, a receptive layer formed of only one of the copolymers was poor with regard to freedom from gloss or luster irregularities and linear image cracking, but a receptive layer formed of both the copolymers was improved with regard to freedom from gloss or luster irregularities and linear image cracking. It has been found out, therefore, that addition of both the copolymers produces a synergistic effect.

As described above, the recording sheet according to the present invention is highly resistant to water and can be used over a long period of time.

The recording sheet according to the present invention can produce clear and sharp images attractive to human eyes because it is free of blurring.

Furthermore, the recording sheet according to the present invention is free of gloss or luster irregularities and linear image cracking even when used with pigment inks. Consequently, the recording sheet according to the present invention is capable of producing printed materials which are free from discoloration even when used with pigment inks.

Although certain preferred embodiments of the present invention have been shown and described in detail, it should be understood that various changes and modifications may be made therein without departing from the scope of the appended claims.

What is claimed is:

1. A recording sheet for recording an image with pigment containing ink comprising:

a base; and an ink receptive layer disposed on at least one surface of said base;

said receptive layer containing at least a water-absorbent copolymer and a water-resistant graft copolymer whose main chain is polyvinyl alcohol;

said water-resistant graft copolymer comprising a graft copolymer produced by grafting a vinyl monomer having a carboxyl group and a vinyl monomer having a functional group reacting with the carboxyl group, said water-resistant graft copolymer being coated on said base wherein said graft copolymer is heated to self-crosslink.

2. A recording sheet according to claim 1, wherein said vinyl monomer having a functional group reacting with the carboxyl group is selected from the group consisting of an acrylamide, glycidyl (meth) acrylate and 2-hydroxyethyl (meth) acrylate.

3. A recording sheet according to claim 1 or 2, wherein said water-absorbent copolymer comprises a copolymer of acrylic acid and vinyl alcohol.

4. A recording sheet according to claim 3, wherein said water-resistant graft copolymer and said water-absorbent copolymer are added at a ratio in parts by weight ranging from 20/80 to 80/20.

5. A recording sheet according to claim 3, wherein said water-resistant graft copolymer and said water-absorbent copolymer are added at a ratio in parts by weight ranging from 30/70 to 70/30.

6. A method of recording an image on a recording sheet, comprising the steps of:

preparing the recording sheet of claim 1; and applying an ink comprising a pigment to said receptive layer to form an image thereon.

7. A method according to claim 6, wherein said vinyl monomer having a functional group reacting with the carboxyl group is selected from the group consisting of an acrylamide, glycidyl (meth) acrylate and 2-hydroxyethyl (meth) acrylate.

8. A method according to claim 6 or 7, wherein said water-absorbent copolymer comprises a copolymer of acrylic acid and vinyl alcohol.

9. A method according to claim 8, wherein said water-resistant graft copolymer and said water-absorbent copolymer are added at a ratio in parts by weight ranging from 20/80 to 80/20.

10. A method according to claim 8, wherein said water-resistant graft copolymer and said water-absorbent copolymer are added at a ratio in parts by weight ranging from 30/70 to 70/30.

* * * * *